US007275951B2

(12) United States Patent
Shigeta et al.

(10) Patent No.: US 7,275,951 B2
(45) Date of Patent: Oct. 2, 2007

(54) CONNECTOR

(75) Inventors: Yoshinori Shigeta, Shizuoka (JP); Akihiro Tsuruta, Shizuoka (JP); Hiromasa Kubota, Shizuoka (JP); Atsushi Nishida, Aichi (JP); Masato Minakata, Aichi (JP); Hiroshi Kobayashi, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/588,421

(22) Filed: Oct. 27, 2006

(65) Prior Publication Data

US 2007/0099496 A1 May 3, 2007

(30) Foreign Application Priority Data

Oct. 27, 2005 (JP) ..... 2005-313404

(51) Int. Cl.
*H01R 13/627* (2006.01)

(52) U.S. Cl. ..... 439/352; 439/357

(58) Field of Classification Search ..... 439/350, 439/352, 353, 354, 357, 358
See application file for complete search history.

(56) References Cited

U.S. PATENT DOCUMENTS 6,077,101 A * 6/2000 Garretson et al. ..... 439/352
6,461,486 B2 * 10/2002 Lorincz et al. ..... 204/224 M
6,514,099 B2 * 2/2003 Endo ..... 439/489
6,568,954 B2 * 5/2003 Endo et al. ..... 439/489
6,595,793 B2 * 7/2003 Tsuji et al. ..... 439/352
6,644,996 B2 * 11/2003 Yamashita ..... 439/352
6,712,635 B1 * 3/2004 Nimura ..... 439/352
6,824,417 B1 * 11/2004 Nimura ..... 439/352
6,835,087 B2 * 12/2004 Yamawaki ..... 439/358
6,840,790 B2 * 1/2005 Endo et al. ..... 439/352
6,918,783 B2 * 7/2005 Endo et al. ..... 439/352
2002/0025711 A1 * 2/2002 Kashiyama et al. ..... 439/352
2003/0049959 A1 * 3/2003 Yamashita ..... 439/352
2003/0087545 A1 * 5/2003 Nimura ..... 439/352
2003/0143885 A1 * 7/2003 Nishide et al. ..... 439/352
2004/0014351 A1 * 1/2004 Endo et al. ..... 439/352
2004/0067676 A1 * 4/2004 Nimura ..... 439/352
2004/0248453 A1 * 12/2004 McLauchlan et al. ..... 439/352
2006/0134964 A1 * 6/2006 Ohtaka et al. ..... 439/358
2006/0194469 A1 * 8/2006 Miyakawa et al. ..... 439/357
2007/0059969 A1 * 3/2007 Shamoto ..... 439/352

FOREIGN PATENT DOCUMENTS

JP 2004-220970 8/2004

* cited by examiner

*Primary Examiner*—Ross Gushi
(74) *Attorney, Agent, or Firm*—Kratz, Quintos & Hanson, LLP

(57) ABSTRACT

The present invention is to provide a connector which is not subjected to an excess force when a locking securing unit is operated to remove engagement. The connector includes a male housing, a locking arm for engaging with a locking projection of a mating connector, a locking securing unit, and deformation switching portions. The locking securing unit is movably disposed between a regulation position to regulate a resilient deformation of the locking arm and an allowance position to allow the resilient deformation thereof. The deformation switching portions have a first interfering portion disposed on the locking arm and a second interfering portion disposed on the locking securing unit. When the locking securing unit is in the allowance position, the first and second interfering portions interfere each other and the locking arm resiliently deforms to remove engagement with the locking projection. When the locking securing unit is in the regulation position, the first and second interfering portions separate each other.

6 Claims, 11 Drawing Sheets

CONNECTOR

BACKGROUND OF THE INVENTION

1. Field of the Invention

The present invention relates to a connector having a locking securing section utilized for connecting an electrical conductor.

2. Description of Related Art

A wire harness is disposed in a vehicle such as a motor vehicle. The wire harness has a connector, which has a tube-shaped connector housing and a terminal received in the housing. The terminal is connected with an end of an electrical conductor.

The connector has a locking securing section to confirm a complete fitting between the connector and a mating connector. A connector disclosed in JP,2004-220970,A has a locking securing unit besides the locking securing section. The connector housing disclosed in JP,2004-220970,A has a locking arm, which resiliently deforms to engage with an engaging portion of the mating connector and resumes a neutral state after connection.

The locking securing unit is movably disposed on the connector housing between a regulation position to regulate a resilient deformation of the locking arm and an allowance position to allow the resilient deformation thereof. When the locking arm is placed in the neutral state, the locking securing unit is movable between the regulation position and the allowance position without an interference of the locking arm. When the locking arm is resiliently deformed, the locking securing unit is regulated to move from the allowance position to the regulation position with the interference of the locking arm.

The connector having the locking securing section is fitted to the mating connector by placing the locking securing unit in the allowance position. After fitting together, the completion of fitting is determined from whether the locking securing unit is movable toward the regulation position.

The connector has a regulating projection to regulate the resilient deformation of the locking arm. When the locking securing unit is placed in the regulation position and the locking arm is disengaged with the engaging portion, the regulating projection abuts on the locking arm which resiliently deforms to disengage from the engaging portion.

In the conventional connector disclosed in JP,2004-220970,A, when the locking securing unit is placed in the regulation position and the locking arm is disengaged, the locking arm is subjected to a force associated with the disengagement and a repulsive force from the regulating projection. The locking arm thus is subjected excess force when the locking arm is operated while the locking securing unit is placed in the regulation position.

When the locking arm is connected with the connector housing at the center thereof and one end is operated and another end engages with the engaging portion (seesaw-type locking), the one end of the locking arm is subjected to a large bending force when the connectors are disengaged, causing to a failure of the locking arm.

SUMMARY OF THE INVENTION

An object of the present invention is to provide a connector which is not subjected to an excess force, when a locking securing unit is in a regulation position, in which the locking arm is regulated to resiliently deform, and the locking arm is operated to remove engagement.

According to a first aspect of the present invention, a connector includes: a connector housing for receiving a terminal; a locking arm connected with the connector housing, the locking arm having a front end to be engaged with an engaging portion of a mating connector, and an operating portion at a rear end thereof; a locking securing unit movably attached to the connector housing, the locking securing unit being movable between a regulation position to regulate a resilient deformation of the locking arm and an allowance position to allow the resilient deformation thereof; and deformation switching portions disposed on the locking arm and the locking securing unit for allowing and regulating the resilient deformation of the locking arm, wherein when the locking securing unit is in the allowance position and the operation portion is operated, the deformation switching portions interfere each other and the locking arm resiliently deforms so that the front end of the locking arm moves upwardly to disengage from the engaging portion, and when the locking securing unit is in the regulation position and the operation portion is operated, the deformation switching portions separate each other and the locking arm is regulated to resiliently deform so that the front end of the locking arm is regulated to move upwardly to disengage from the engaging portion.

Preferably, the deformation switching portions have a first interfering portion disposed on the locking arm and a second interfering portion disposed on the locking securing unit, the first and second interfering portions interfere each other when the locking securing unit is in the allowance position, and the first and second interfering portions separate each other when the locking securing unit is in the regulation position.

Preferably, the connector further includes a position regulating portion for regulating a displacement between the first and second interfering portions when the locking securing unit is in the allowance position and the operation portion is operated.

Preferably, the position regulating portion has a first projection on the first interfering portion and a second projection on the second interfering portion.

Preferably, the first interfering portion projects from the locking arm and the second interfering portion projects from the locking securing unit, the first projection is disposed on a front end of the first interfering portion and the second projection is disposed on a rear end of the second interfering portion, and the second projection is positioned between the locking arm and the first projection and the first projection is positioned between an inner wall of the locking securing unit and the second projection when the locking securing unit is in the allowance position.

Preferably, the locking arm includes: a pair of supporting arms having a cantilever shape, each supporting arm having a rear end connected with the connector housing and a free front end, a locking beak interconnecting the front ends of the supporting arm, and an unlocking arm connected with the front end of the supporting arm and extending toward a rear end of the supporting arm.

DETAILED DESCRIPTION OF THE PREFERRED EMBODIMENTS

Figure 1:
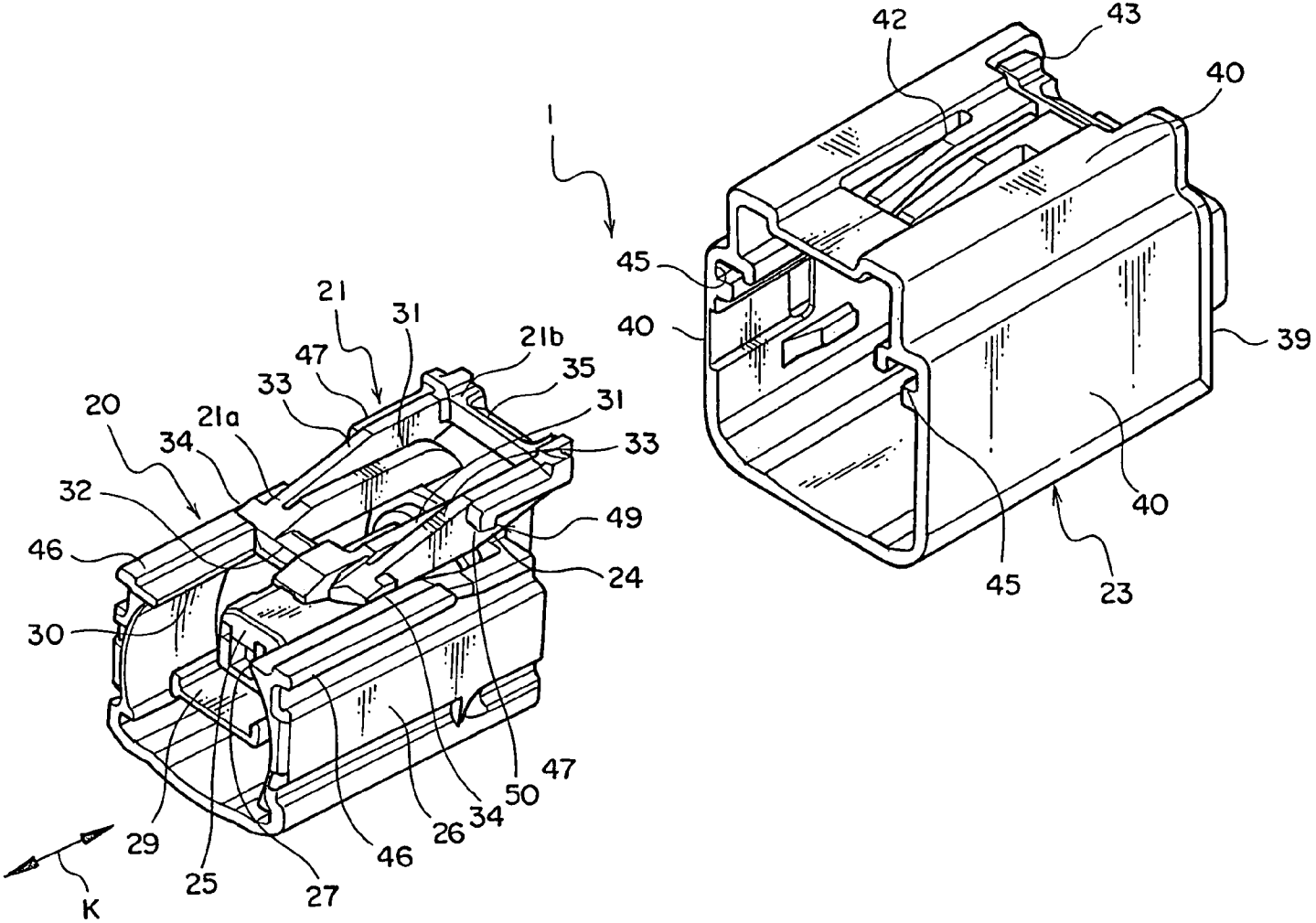
FIG. 1 is an exploded perspective view showing an essential portion of an embodiment of a connector of the present invention.

An embodiment of a connector having a locking securing section of the present invention is explained by referring to FIGS. 1-19. A connector 1 of FIG. 1 fits with a mating connector 2 shown in FIGS. 7-18.

As shown in FIGS. 7-18, the mating connector 2 includes a female type connector housing 3, hereafter female housing, a male type terminal 4, hereafter male terminal, and a short-circuit terminal 5.

As shown in FIGS. 7-18, the female housing 3 is formed from a synthetic resin and includes a main body 6 for receiving a plurality of the male terminals 4, a tubular coat 7 for receiving a male housing 20, and a receiving portion 8 for receiving the short-circuit terminal 5. The tubular-shaped connector housing for accepting the male housing 20 therein is referred to the female type connector housing 3.

The main body 6 has a plurality of terminal-receiving chambers 9 juxtaposed to each other, which extend straight and receive the male terminals 4. The terminal-receiving chambers 9 each have a locking arm 10, which projects from an inner surface thereof, to lock the respective terminal 4.

The coat 7 is formed in a box shape and has a plurality of outer walls 11 connected with the respective outer edges of the main body 6. The coat 7 has an opening for accepting the male housing 20 at a front end thereof. The outer wall 11 located in an upper side of the coat 7 in the drawings has a locking projection 12 as an engaging portion at an outer surface thereof.

The receiving portions 8 of the short-circuit terminal 5 are disposed in the female housing 3 and extend over the main body 6 and the coat 7 and are superposed on the terminal-receiving chambers 9. The female housing 3 is the mating connector housing in this specification.

Each male terminal 4 is formed by punching a conductive plate and bending the plate. The male terminal 4 has an electrical conductor connecting portion 13 and an electrical contacting portion 14, which are integral each other. The electrical conductor connecting portion 13 is electrically connected to an electrical wire of a respective electrical conductor 15. The electrical contacting portion 14 has a rod shape and is inserted into an electrical contacting portion 37 of a female terminal 22 for electrical connection with the female terminal 22.

When the male terminal 4 is attached to the female housing 3, the electrical contacting portion 14 is placed in the coat 7 and the electrical conductor connecting portion 13 is received in the terminal-receiving chamber 9. The male terminal 4 is the mating terminal in the specification.

The short-circuit terminal 5 is formed by punching and bending a conductive metal. The short-circuit terminal 5 has a retaining portion 16 and a pair of resilient pieces 17, which are formed integrally. FIGS. 7, 9, 11, 13, 15, 17 show only one resilient piece. The retaining portion 16 is received in the receiving portion 8 of the short-circuit terminal and attached to the female housing 3.

One end of the resilient pieces 17 is connected to the retaining portion 16 and a middle portion thereof 17 is bent toward the electrical contacting portion 14 of the male terminal 4. The middle portions of the resilient pieces 17 are resilient in a direction separating away from the electrical contacting portion 14. The resilient pieces 17 resiliently contact the electrical contacting portion 14. When the mating connector 2 is not fitted with the connector 1, each resilient piece 17 resiliently contacts the electrical contacting portion 14 so as to electrically connect the male terminals 4 each other.

As shown in FIGS. 1-2 and 5-6, the connector 1 includes the male hosing 20, a locking arm 21, the female terminal (not shown) 22, a locking securing unit 23, and a deformation switching portion 24.

The male housing 20 is formed from a synthetic resin and has a main body 25 to receive the plurality of the female terminals 22, and a tubular hood 26.

The main body 25 has a box shape and has a plurality of terminal-receiving chambers 27 juxtaposed each other. Each terminal-receiving chamber 27 extends straight and has openings at ends thereof and receives the respective female terminal 27. Locking arms, not shown, are disposed in the terminal-receiving chambers 27. The main body 25 is inserted into the coat 7 of the female housing 3 so that each terminal-receiving chamber 27 communicates with the respective terminal-receiving chamber 9 of the female housing 3.

An outer surface of the main body 25 is encircled with a packing 28 such as rubber. When the connectors 1 and 2 are fitted together, the packing 28 abuts on an inner surface of the coat 7 of the female housing 3 so as to keep the terminal-receiving chambers 27 of the main body 25 water-tight.

The main body 25 has a short-circuit releasing piece 29 which is integral with the main body 25 and formed from an insulating synthetic resin and has a plate shape. The short-circuit releasing piece 29 extends toward the mating connector 2. When the connectors 1 and 2 are fitted together, the short-circuit releasing piece 29 enters between the resilient pieces 17 of the short-circuit terminal 5 and the electrical contacting portions 14 of the male terminal 4 so at to disconnect the electrical connection therebetween.

The main body 25 is received in the hood 26 and both are connected at bottoms thereof. The hood 26 has a cutout 30 extending to the bottom of the hood 26 in a fitting direction K denoted in FIGS. 1-2 and 5-7.

The locking arm 21 is disposed in the cutout 30 and has a pair of supporting arms 31, a locking beak 32, a pair of unlocking arms 33, a pair of supporting projections 34, and an operating portion 35.

The pair of the supporting arms 31 are disposed parallel each other with a distance. Rear ends of the supporting arms 31 are connected a rear end of the main body 25 and front ends thereof are free. The locking beak 32 interconnects the front ends of the supporting arms 31.

The pair of the unlocking arms 33 have a rod shape and extend in a longitudinal direction of the female terminals 22. The unlocking arms 33 are disposed parallel and separated each other. The unlocking arms 33 are disposed outside the supporting arms 31. Front ends of the unlocking arms 33 are connected with the front ends of the supporting arms 31 and rear ends thereof are free.

The supporting projections 34 project from the front ends of the unlocking arms 33 and extend outwardly from the unlocking arms 33. The operating portion 35 interconnects the pair of the unlocking arms 33.

When the connectors 1 and 2 are fitted together, a front end 21*a* of the locking arm 21 engages with the locking projection 12 by positioning the locking projection 12 between the supporting arms 31 and the locking beak 32. When the locking arm 21 engages with the locking projection 12, the locking beak 32 abuts on the locking projection 12 and climbs up the locking projection 12. The front end 21*a* of the locking arm 21 is moved outwardly from the locking projection 12 and the locking arm 21 is thus resiliently deformed. When the locking beak 32 climbs over the locking projection 12, the locking arm 21 returns to the neutral state and the locking projection 12 is positioned between the pair of the supporting arms 31 and the locking beak 32.

The operating portion 35 is then depressed toward the main body 25 of the male housing 20 so that interfering portions 47 and 48 interfere each other, and the locking beak 32 or the front end 21*a* of the locking arm 21 is moved outwardly from the locking projection 12 and the locking arm 21 is resiliently deformed. It is apparent that the locking arm 21 is disengaged from the locking projection 12 by depressing the operating portion 35.

The female terminals 22 are formed by punching and bending a conductive metal plate. The female terminals 22 each have an electrical conductor connecting portion 36 and an electrical contacting portion 37 continued to the electrical conductor connecting portion 36. The electrical conductor connecting portion 36 is connected to an electrical conductor 38 and electrically connected with an electrical wire. The electrical contacting portion 37 is formed in a tube shape and accepts the electrical contacting portion 14 of the male terminal 4.

The female terminals 22 are received in the terminal-receiving chambers 27 with the electrical contacting portions 37 facing to the mating connector 2.

The locking securing unit 23 is formed from an insulating synthetic resin. The locking securing unit 23 has a rear wall 39, a plurality of peripheral walls 40 upstanding from the rear wall 39, and a front opening. The rear wall 39 has a through hole 41 to accept the electrical conductor 38 attached to the female terminal 22 as shown in FIGS. 3-4.

The locking securing unit 23 has an interfering arm 42 in an upper wall of the peripheral walls 40 and an operating bore 43 extending from the upper wall to the rear wall 39 as shown in FIGS. 1 and 4.

The interfering arm 42 is formed in a belt shape and extends in the fitting direction K. A rear end of the interfering arm 42 is connected to a rear end of the upper portion of the peripheral walls 40. The interfering arm 42 has an interfering projection 44, which extends inside the locking securing unit 23, at a front end thereof. The operating bore 43 passes through the peripheral wall 40 and the rear wall 39.

The locking securing unit 23 and the male housing 20 are fitted together so as to make the rear wall 39 facing to a rear end of the male housing 20. The interfering projection 44 overlaps with the locking arm 21 and the operating portion 35 is exposed through the operating bore 43.

The locking securing unit 23 is slidably attached to the male housing 20 in the range between the regulation position and the allowance position. In the regulation position (FIG. 6), the rear wall 39 intimately contacts the rear end of the main body 25. In the allowance position (FIG. 5), the rear wall 39 is separated from the rear end of the main body 25. Guiding walls 45 and guiding projections 46 are disposed between the inner wall of the locking securing unit 23 and the outer surface of the male housing 20 for guiding movement of the locking securing unit 23 and the male housing 20 in the fitting direction K.

Regulating projections (not shown) for regulating the over-movement of the locking securing unit 23 against the male housing 20 are disposed on an inner wall of the locking securing unit 23 and an outer surface of the male housing 20. Projections for providing a click sound to the movement of the locking securing unit 23 between the regulation position and the allowance position are also disposed on the inner wall of the locking securing unit 23 and the outer surface of the male housing 20. The click sound occurs when the locking securing unit 23 is positioned in the regulation position and allowance position. The locking securing unit 23 is subjected to a resistance against the movement thereof between the regulation and allowance positions.

Figure 7:
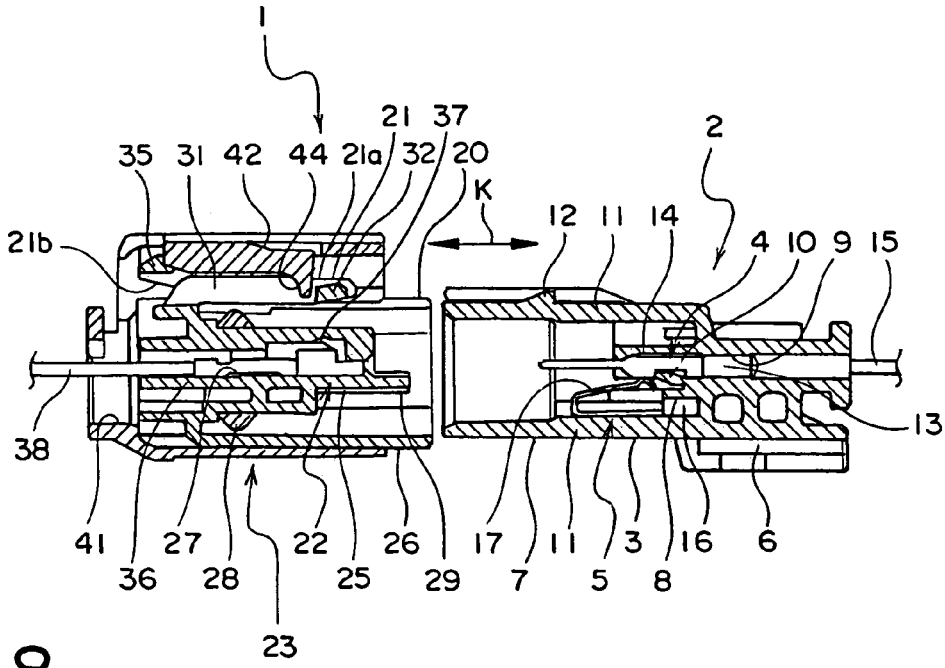
FIG. 7 is a sectional view of the connector and a mating connector of FIG. 5 taken along VII-VII.

As shown in FIG. 7, when the locking securing unit 23 is in the allowance position, the interfering projection 44 of the interfering arm 42 is positioned away from the front opening of the locking securing unit 23 with respect to the locking beak 32 and positioned between the pair of the supporting arms 31 and the locking beak 32. The interfering projection 44 of the interfering arm 42 thus does not interfere with the locking beak 32 of the locking arm 21 so that the interfering projection 44 allows the locking arm 21 to resiliently deform in the direction that the locking beak 32 separates from the main body 25.

When the locking securing unit 25 is in the regulation position, the interfering projection 44 is positioned at a front end of the locking beak 32 so that the locking projection 44 of the locking arm 42 interferes with the locking beak 32, and regulates the locking arm 21 to resiliently deform and the locking beak 25 to separate from the main body 25.

Figure 2:
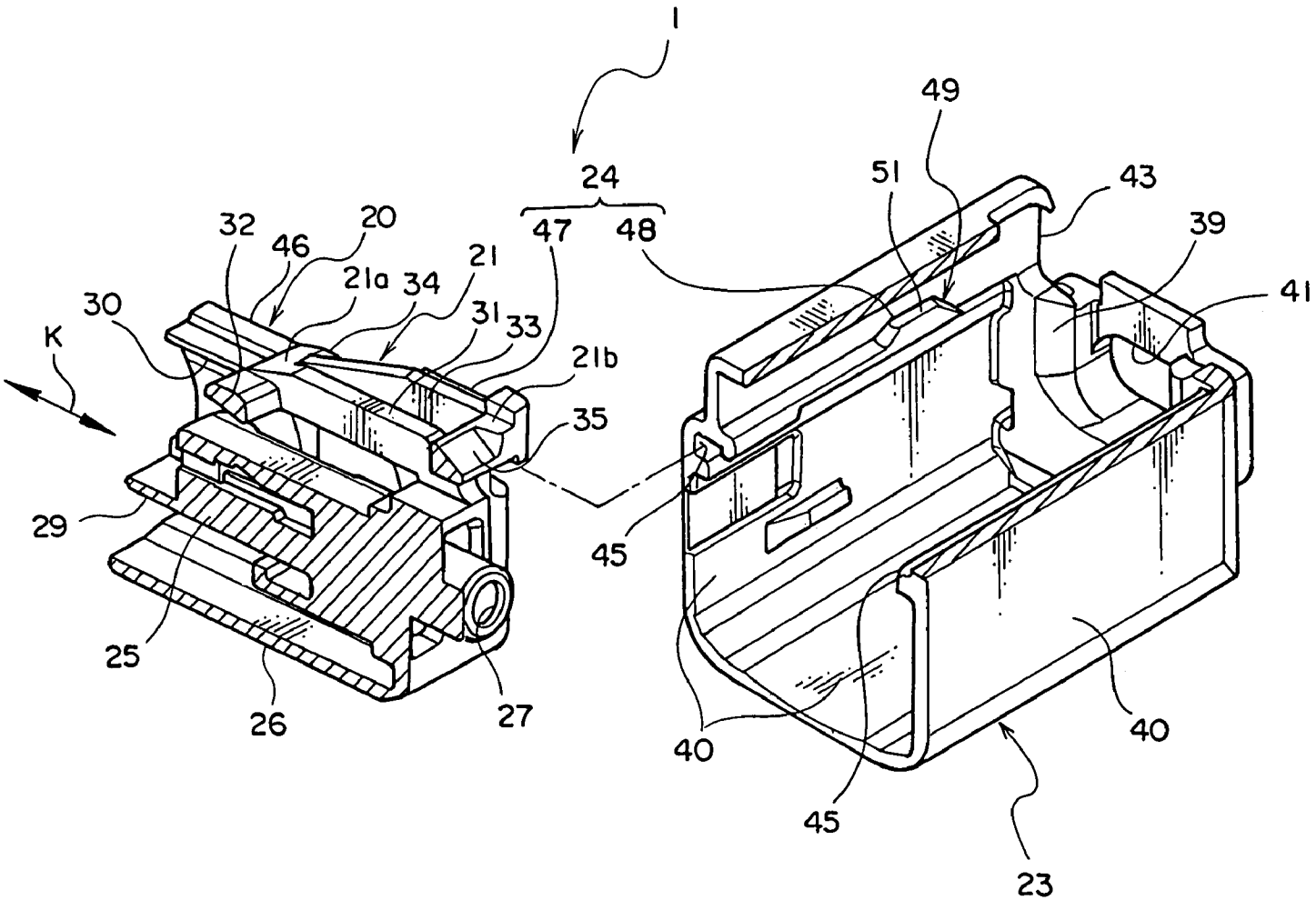
FIG. 2 is a perspective view of the connector of FIG. 1, partially a sectional view.

The deformation switching portions 24 have the first interfering portions 47 disposed on the locking arm 21, shown in FIG. 1, the second interfering portions 48 disposed on the locking securing unit 23, shown in FIG. 2, and position regulating portions 49, shown in FIGS. 1 and 2. The deformation switching portions 24 are thus disposed on the locking arm 21 and the locking securing unit 23.

The first interfering portions 47 are disposed along the unlocking arms 33 and project outwardly from the unlocking arms 33. The second interfering portions 48 project inwardly from the inner walls of the locking securing unit 23. Both the first and second interfering portions 47, 48 extend straight in the fitting direction K of the male hosing 20 and the locking securing unit 23 so that both interfering portions 47, 48 allow (or do not prevent) the locking securing unit 23 to move against the male housing 20.

When the locking securing unit 23 is in the allowance position, the first interfering portions 47 are positioned above the second interfering portions 48 and abut on the second interfering portions 48. Accordingly, when the operating portion 35 of the locking arm 21 is depressed toward the main body 25, the first and second interfering portions 47, 48 intimately contact or interfere each other.

When the locking securing unit 23 is in the regulation position, the first and second interfering portions 47, 48 are separated each other. Accordingly, when the operating portion 35 of the locking arm 21 is depressed toward the main body 25, the first and second interfering portions 47, 48 do not contact or interfere each other.

Figures 3A, 3B:
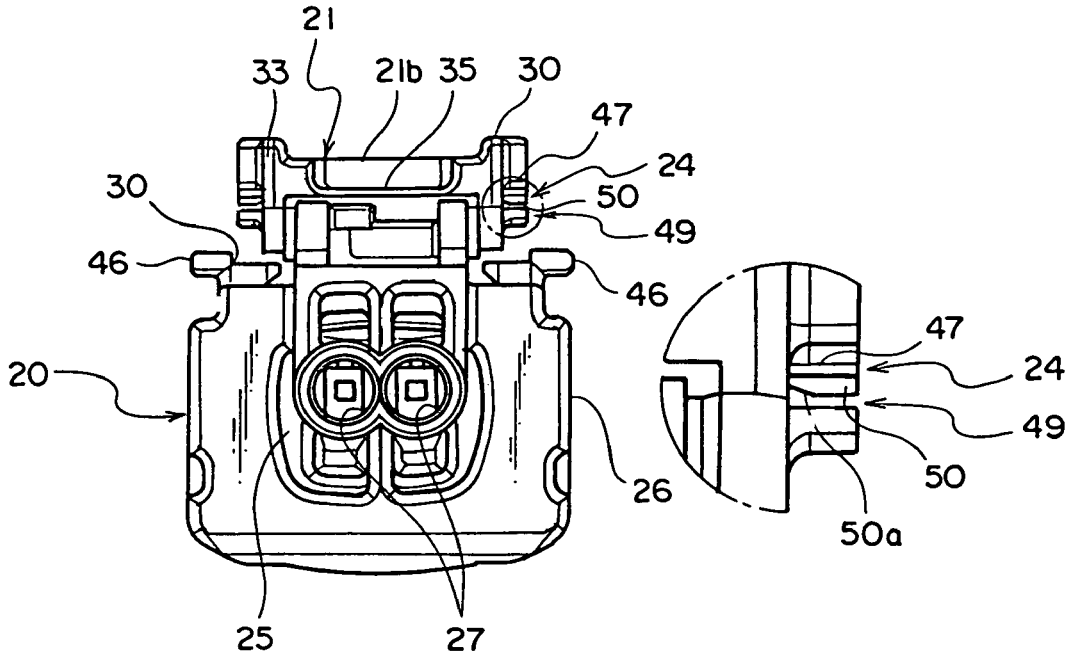
FIG. 3A is a rear view of a male housing of the connector of FIG. 1.
FIG. 3B is an expanded view of a circled portion of FIG. 3A.

The position regulating portions 49 each have a first projection 50, shown in FIG. 3, and a second projection 51, shown in FIG. 4. The first projection 50 is disposed on a front end of the first interfering portion 47 and projects toward the second interfering portion 48 and extends toward the second interfering portion 48. The first projection 50 has a slope face 50*a* extending toward the locking arm 21 and separating away from the second interfering portion 48 as shown in FIG. 3B.

Figures 4A, 4B:
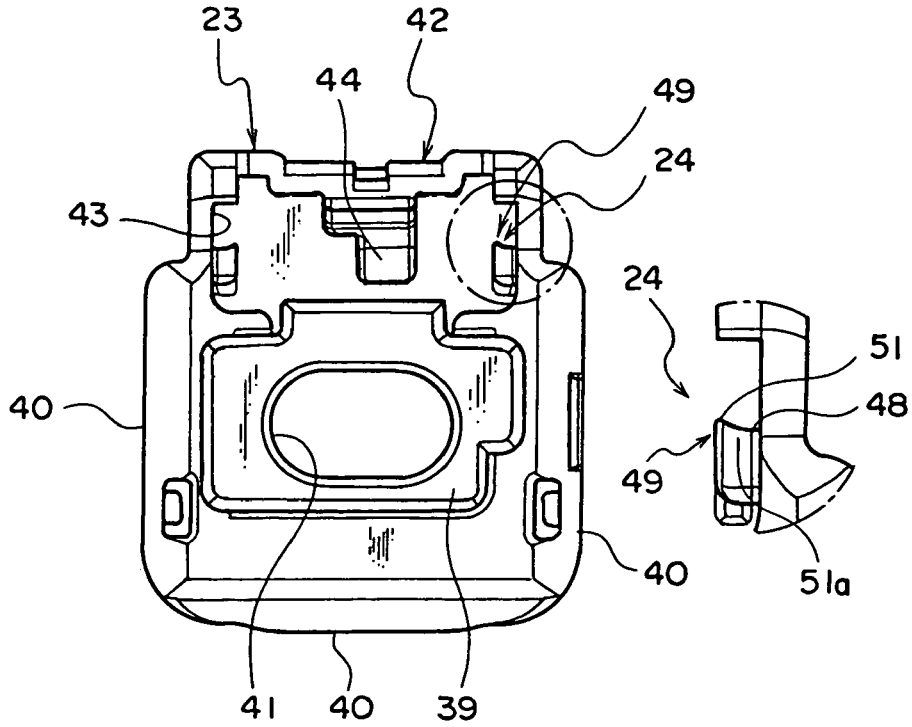
FIG. 4A is a rear view of a locking securing unit of the connector of FIG. 1.
FIG. 4B is an expanded view of a circled portion of FIG. 4A.
Figure 5:
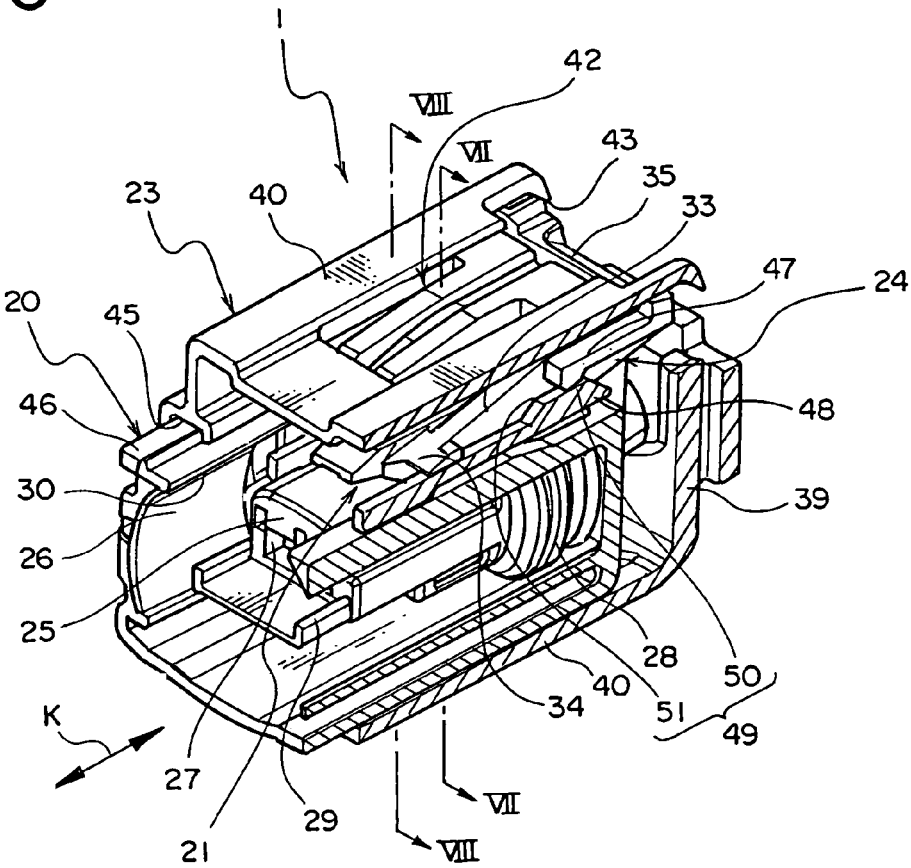
FIG. 5 is a perspective view showing a state that the locking securing unit of the connector of FIG. 1 is in an allowance position, partially a sectional view.
Figure 6:
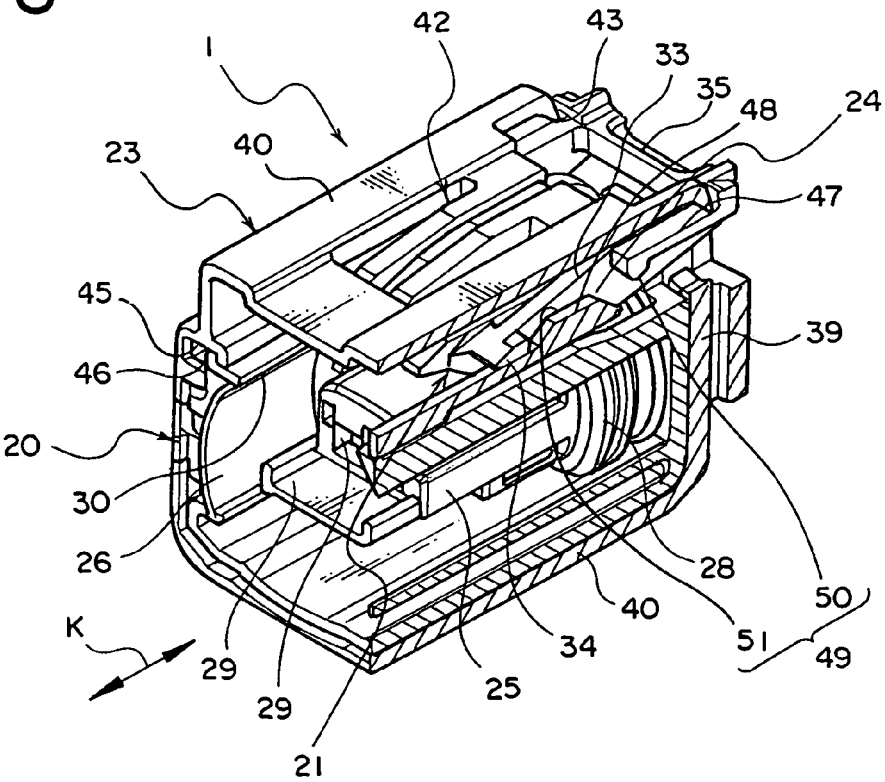
FIG. 6 is a perspective view showing a state that the locking securing unit of the connector of FIG. 1 is in a regulation position, partially a sectional view.

The second projection 51 is disposed on a rear end of the second interfering portion 48 separated from the inner wall of the locking securing unit 23 and projects toward the first interfering potion 47 and extends toward the first interfering portion 47. The second projection 51 has a slope face 51*a* extending inside the locking securing unit 23 and gradually separating away from the first interfering portion 47 as shown in FIG. 4B.

Both the first and second projections 50, 51 extend straight in the fitting direction K.

When the locking securing unit 29 is in the allowance position, each position regulating portions 49 positions the second projection 51 between the first projection 50 and the unlocking arm 33 and positions the first projection 50 between the second projection 51 and the inner wall of the locking securing unit 23 so that the slope faces 50*a*, 51*a* overlap each other. When the locking securing unit 23 is in the allowance position and the operating portion 35 of the locking arm 21 is depressed, the first and second interfering portions 47, 48 regulate the locking securing unit 23 to displace in the direction perpendicular to the fitting direction K.

When the locking securing unit 23 is in the allowance position and the operating portion 35 is depressed toward the main body 25, the first and second interfering portions 47, 48 interfere each other. The deformation switching portion 24 thus resiliently deforms the unlocking arms 33 to separate the locking beak 32 from the main body 25. When the locking securing unit 23 is in the allowance position, the deformation switching portion 24 resiliently deforms the locking arm 21 to disengage the front end 21*a* of the locking arm 21 from the locking projection 12 of the mating connector 2.

When the locking securing unit 23 is in the regulation position and the operating portion 35 is depressed toward the main body 25, the first and second interfering portions 47, 48 do not interfere each other. The supporting projections 34 of the locking arm 21 abut on the inner walls of the locking securing unit 23 so that the deformation switching portion 24 resiliently deforms the unlocking arm 33 against the supporting projections 34. The supporting projections 34 are disposed on the front end 21*a* of the locking arm 21 so that the supporting arms 31 is hardly displaced. The locking beak 32 thereby is not separated from the main body 25. The deformation switching portion 24 thereby regulates the locking arm 21 to resiliently deform and the front end 21*a* of the locking arm 21 to disengage from the locking projection 12.

Figure 8:
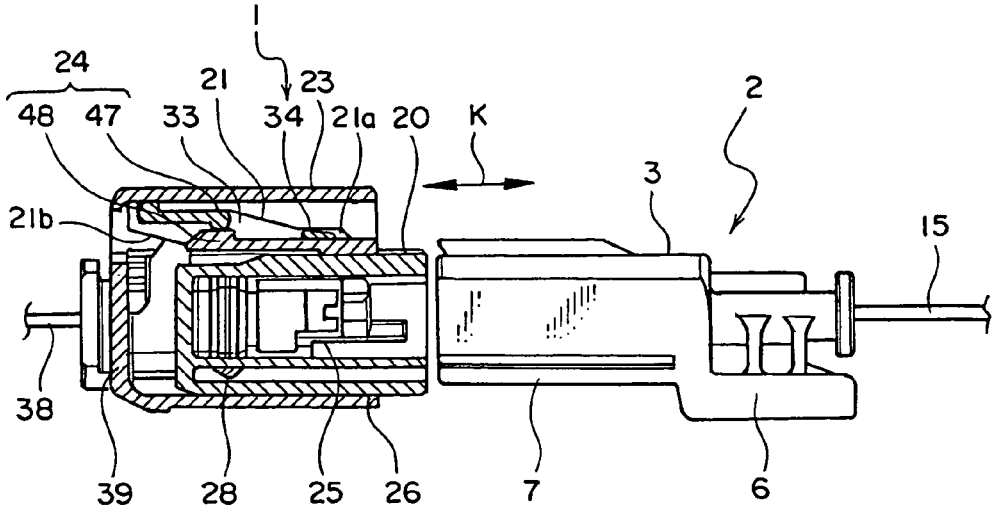
FIG. 8 is a sectional view of the connector and the mating connector of FIG. 5 taken along VIII-VIII.
Figure 9:
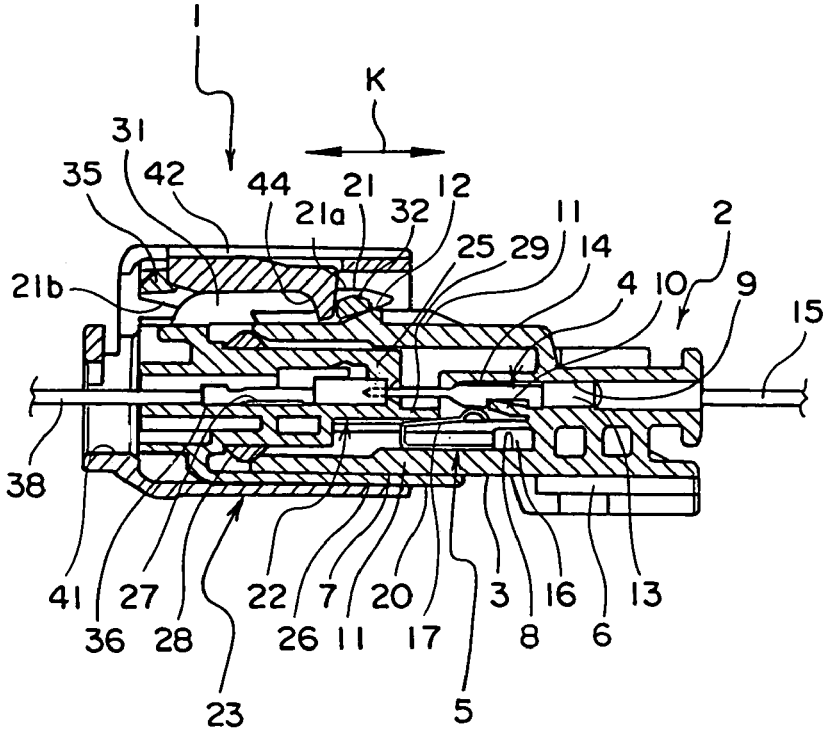
FIG. 9 is a sectional view showing both connectors of FIG. 7 positioned close each other.
Figure 10:
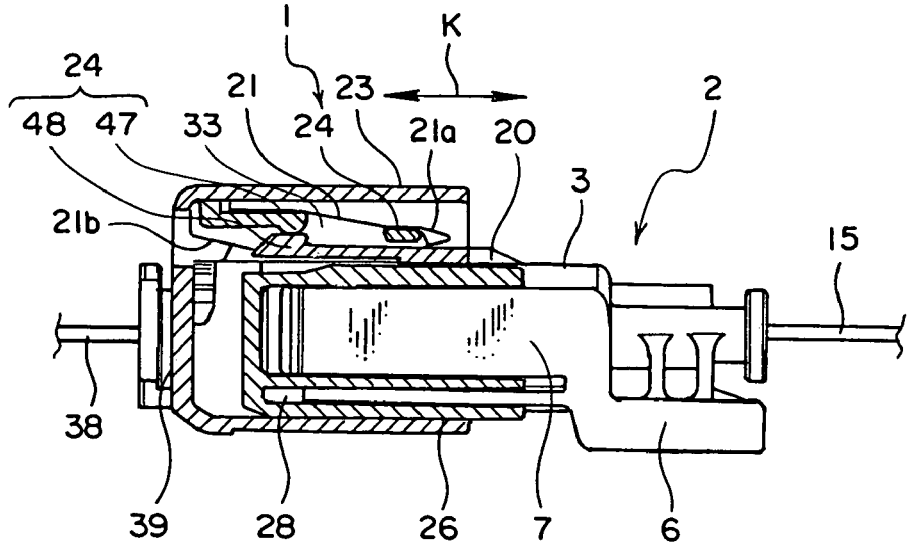
FIG. 10 is a sectional view showing both connectors of FIG. 8 positioned close each other.

When the connector 1 is fitted to the mating connector 2, as shown in FIGS. 7-8, the locking securing unit 23 is positioned in the allowance position and the connector 1 is placed opposite to the mating connector 2 with a distance. As shown in FIGS. 9-10, the connector 1 is approached to the mating connector 2 and the main body 25 is inserted into the coat 7 of the mating connector 2 and the coat 7 is entered between the outer wall of the main body 25 and the inner wall of the hood 26. The locking beak 32 then climbs on the locking projection 12.

Figure 11:
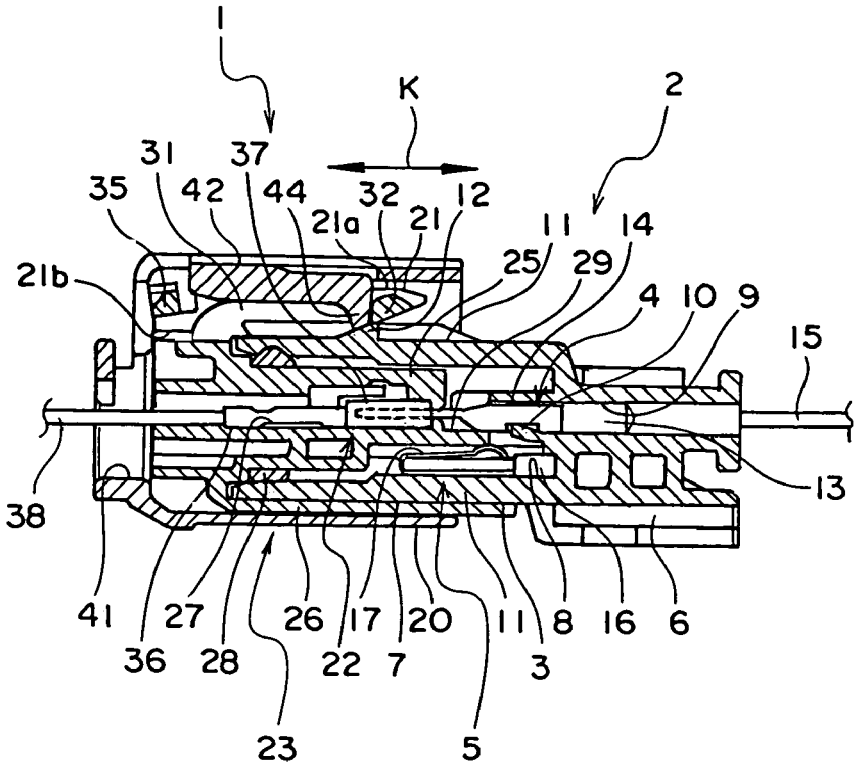
FIG. 11 is a sectional view showing that a locking beak of a locking arm of the connector of FIG. 9 climbs on a locking projection of the mating connector.
Figure 12:
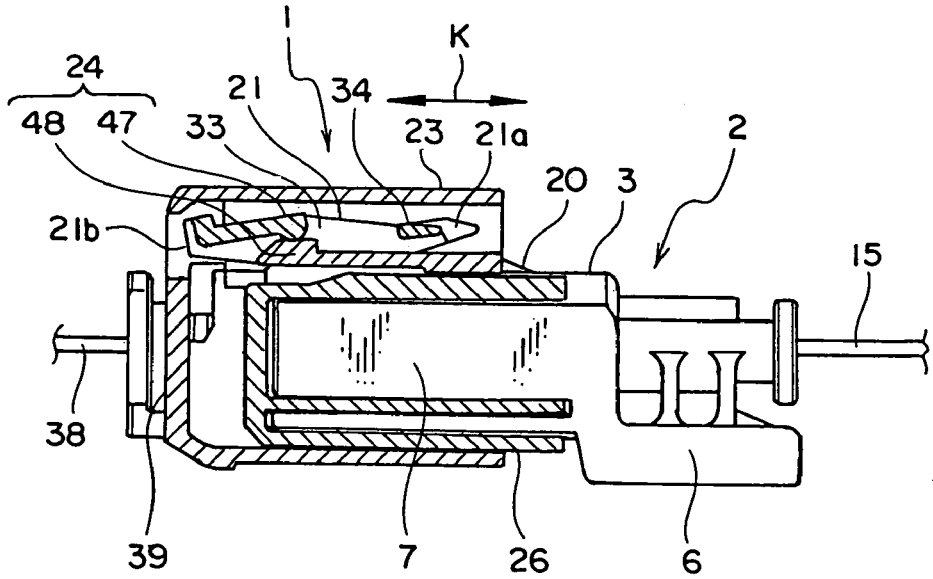
FIG. 12 is a sectional view showing that the locking beak of the locking arm of the connector of FIG. 10 climbs on the locking projection of the mating connector.
Figure 13:
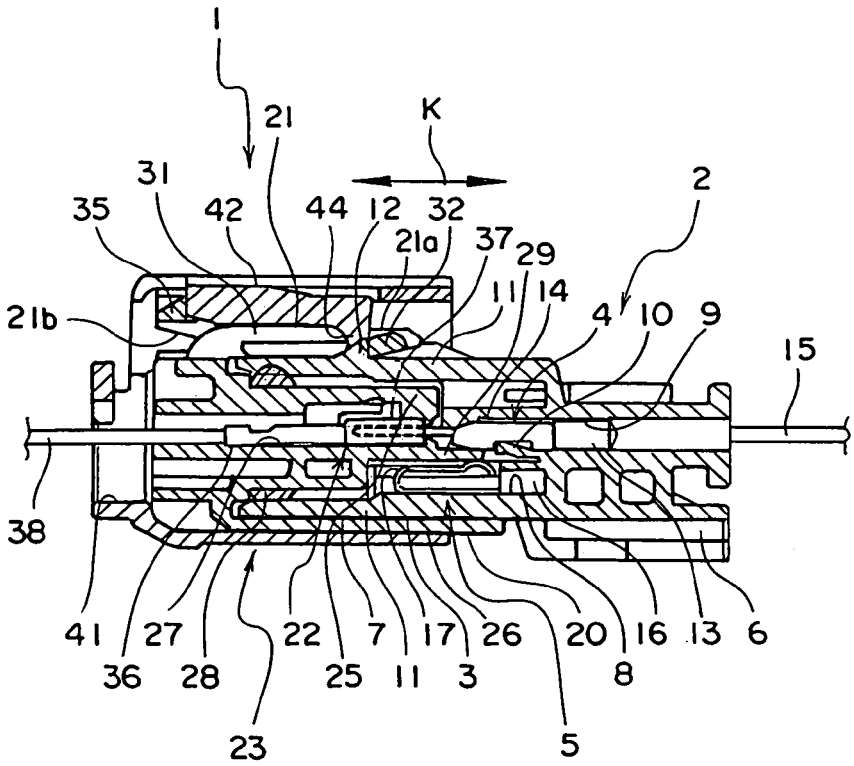
FIG. 13 is a sectional view showing a state that the locking arm of the connector is engaged with the locking projection of the mating connector of FIG. 11.
Figure 14:
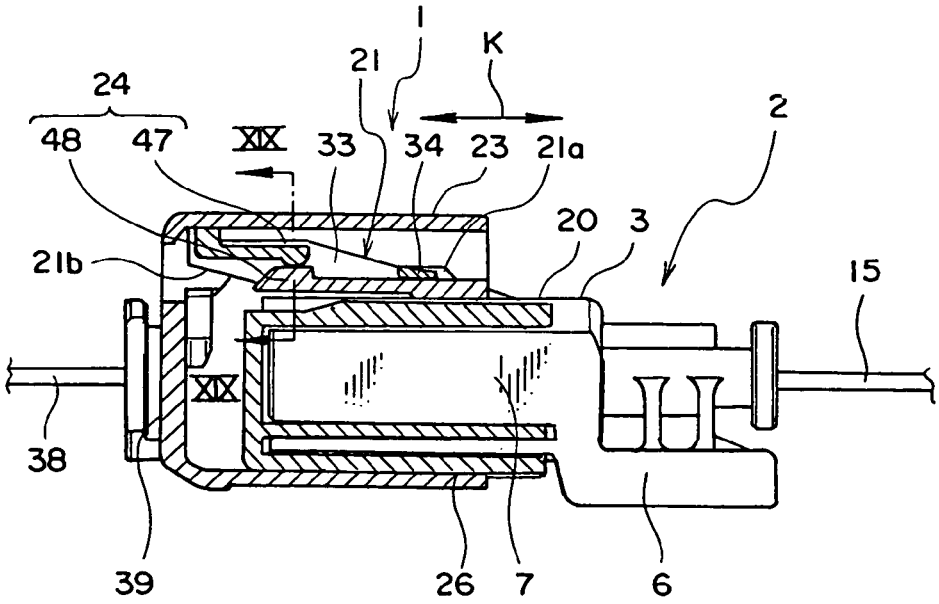
FIG. 14 is a sectional view showing a state that the locking arm of the connector is engaged with the locking projection of the mating connector of FIG. 12.

When the connectors 1 and 2 are further approached each other, as shown in FIG. 11, the short-circuit receiving piece 29 enters between the resilient piece 17 and the electrical contacting portion 14 of the male terminal 4. The locking beak 32 climbs on the locking projection 12 and resiliently deforms the locking arm 21 as shown in FIGS. 11-12. As shown in FIG. 13, the locking beak 32 climbs over the locking projection 12 and the locking arm 21 returns to the neutral state, no resilient deformation, shown in FIGS. 13-14, so that the locking arm 21 fits with the locking projection 12.

Figure 15:
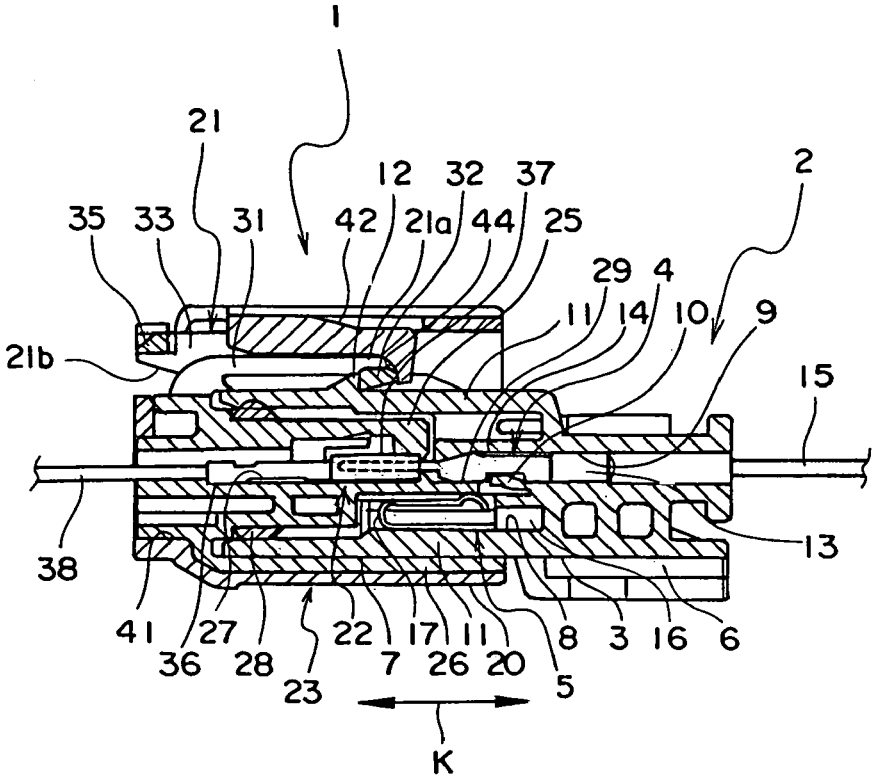
FIG. 15 is a sectional view showing that a locking securing unit of the connector of FIG. 13 is in a regulation position.
Figure 16:
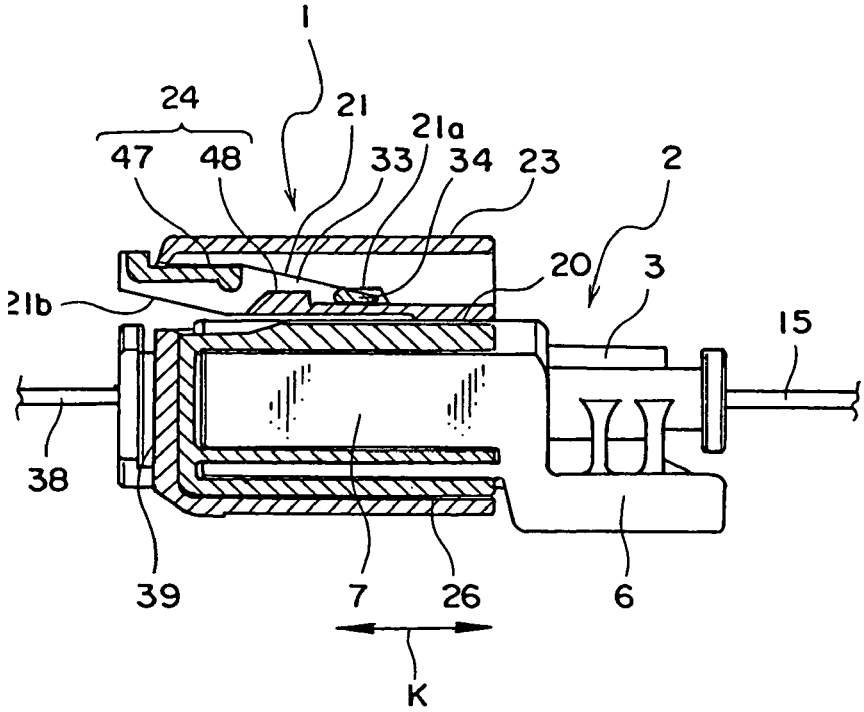
FIG. 16 is a sectional view showing that the locking securing unit of the connector of FIG. 14 is in the regulation position.

The locking securing unit 23 is then positioned to the regulation position as shown in FIGS. 15-16. The connector 1 is thus fitted to the mating connector 2. As shown in FIGS. 9 and 11, when the locking beak 32 is on the locking projection 12 (incomplete fitting state), the interfering projection 44 of the interfering arm 42 interferes with the locking beak 32 on the locking projection 12 so that the locking securing unit 23 is regulated about movement from the allowance position to the regulation position.

Figure 17:
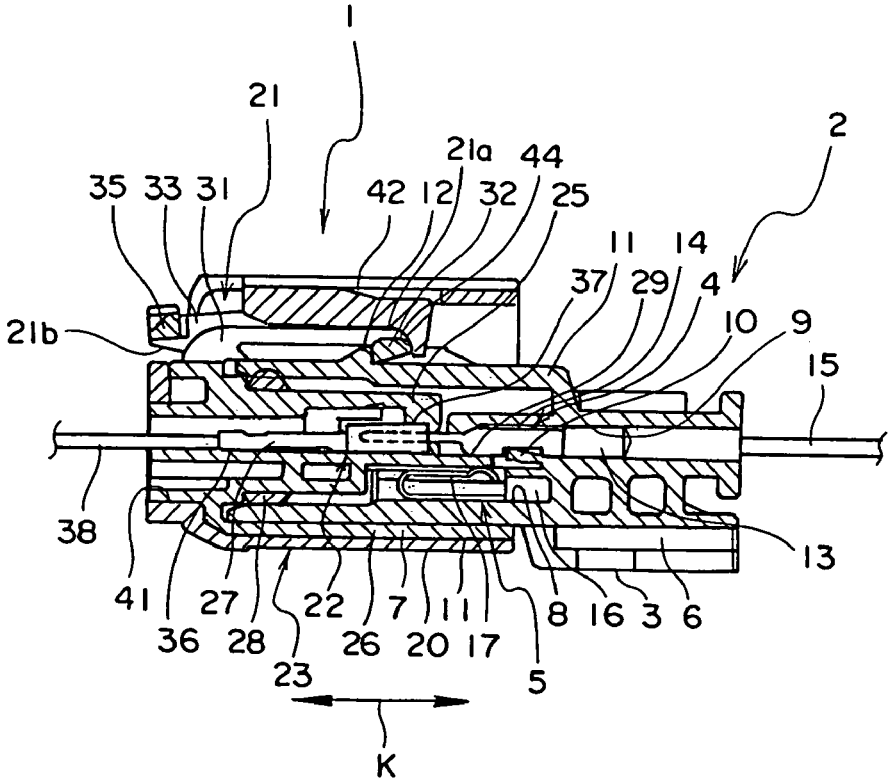
FIG. 17 is a sectional view showing that an operating portion of the locking arm of the connector of FIG. 15 is depressed.
Figure 18:
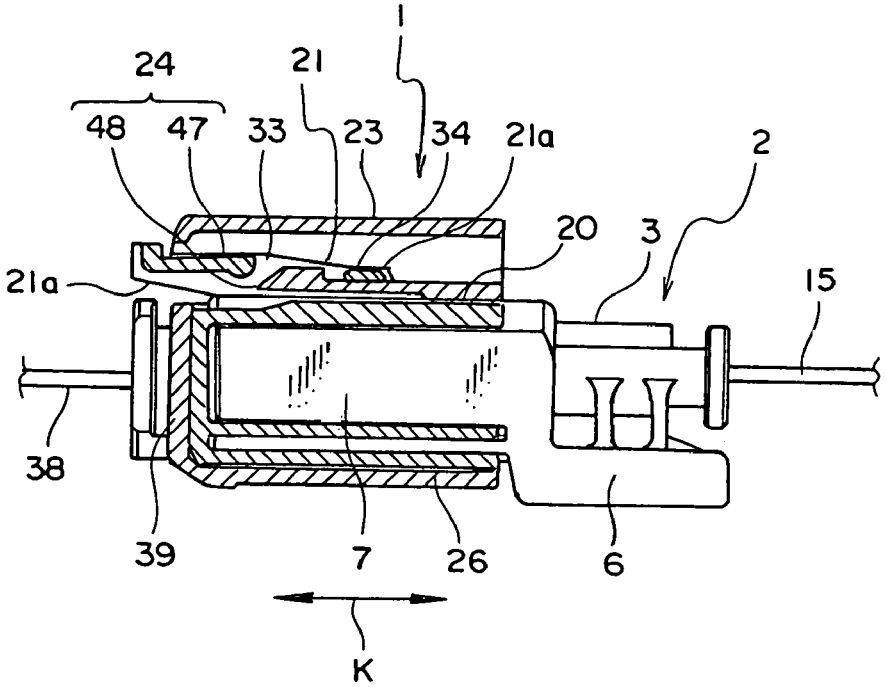
FIG. 18 is a sectional view showing that the operating portion of the locking arm of the connector of FIG. 16 is depressed.
Figure 19:
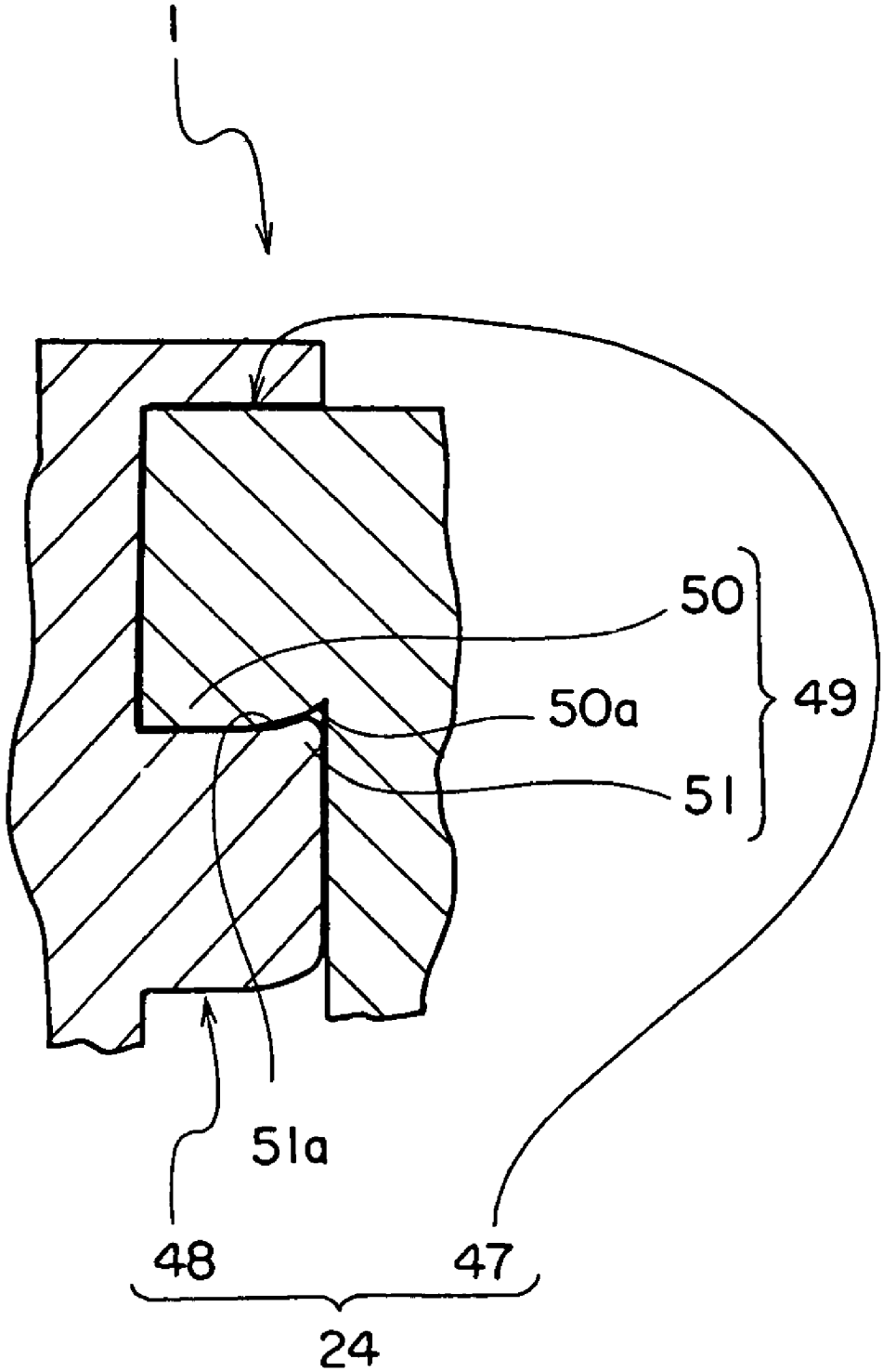
FIG. 19 is a sectional view of FIG. 14 taken along the line XIX-XIX.

When the locking securing unit 23 is positioned to the regulation position, as shown in FIGS. 18, the first and second interfering portions 47 and 48 are separated each other. When the operating portion 35 is depressed toward the main body 25, the unlocking arms 33 resiliently deform with respect to the front end 21*a* of the locking arm 21 but the supporting arms 31 do not resiliently deform. As shown in FIGS. 17-18, the front end 21*a* of the locking arm 21 do not displace in the disengaging direction.

In the embodiment of the present invention, the first and second interfering portions 47, 48 (deformation switching portion 24) do not interfere each other when the locking securing unit 23 is in the regulation position. The locking arm 21 thus does not resiliently deform in the disengaging direction thereof even the locking arm 21 is operated to disengage the fitting. The locking arm 21 is thereby prevented from subjecting an excess stress.

The deformation switching portion 24 of the locking securing unit 23 can be disposed on optional positions depending on the position of waterproof packing. The deformation switching portions 24 of the locking arm 21 and the locking securing unit 23 are separable so that the locking arm 21 can be disengaged from the locking projection 12 with a small operating force.

The deformation switching portions 24 have the first interfering portions 47 disposed on the locking arm 21 and the second interfering portions 48 disposed on the locking securing unit 23. When the locking securing unit 23 is in the allowance position, both interfering potions 47, 48 interfere each other so that the locking arm 21 can be assuredly deformed and the connectors 1 and 2 become easily detachable each other.

When the locking securing unit 23 is in the allowance position, the position regulating portion 49 regulates the interfering portions 47, 48 to displace each other so that the locking arm 21 can be assuredly deformed and the connectors 1 and 2 become easily detachable each other.

The position regulating portions 49 each have the first projection 50 of the first interfering portion 47 and the second projection 51 of the second interfering portion 48 so that the position displacement between the first and second interfering portions 47, 48 is assuredly prevented. The locking arm 21 can be assuredly deformed in the disengaging direction. The connectors 1 and 2 are assuredly fitted and disconnected each other.

The second projections 51 are disposed between the locking arm 21 and the first projections 50 and the first projections 50 are disposed between the locking securing unit 23 and the second projections 51 so that the position regulating portion 49 can assuredly regulate the displacement between the first and second interfering portions 47 and 48. The locking arm 21 can be assuredly deformed in the disengaging direction. The connectors 1 and 2 are assuredly fitted and disconnected each other.

The unlocking arms 33 extend along the supporting arms 31 and are extendable further. The long unlocking arms 33 disengage the fitting of the connectors 1 and 2 with a small force.

The embodiment of the present invention is only exemplary and not limited thereto. Any alteration and modification are within the scope of the present invention. For example, the position regulating portion 49 may not be disposed. Any configurations of the first and second projections 50 and 51 of the position regulating portions 49 are possible. Any configurations of the first and second interfering portions 47 and 48 are possible.

What is claimed is:

1. A connector comprising:

a connector housing for receiving a terminal;

a locking arm connected with the connector housing, the locking arm having a front end to be engaged with an engaging portion of a mating connector, and an operating portion at a rear end thereof;

a locking securing unit movably attached to the connector housing, the locking securing unit being movable between a regulation position to regulate a resilient deformation of the locking arm and an allowance position to allow the resilient deformation thereof; and deformation switching portions disposed on the locking arm and the locking securing unit for allowing and regulating the resilient deformation of the locking arm, wherein when the locking securing unit is in the allowance position and the operation portion is operated, the deformation switching portions interfere each other and the locking arm resiliently deforms so that the front end of the locking arm moves upwardly to disengage from the engaging portion, and when the locking securing unit is in the regulation position and the operation portion is operated, the deformation switching portions separate each other and the locking arm is regulated to resiliently deform so that the front end of the locking arm is regulated to move upwardly to disengage from the engaging portion.

2. The connector as claimed in claim 1, wherein the deformation switching portions have a first interfering portion disposed on the locking arm and a second interfering portion disposed on the locking securing unit, the first and second interfering portions interfere each other when the locking securing unit is in the allowance position, and the first and second interfering portions separate each other when the locking securing unit is in the regulation position.

3. The connector as claimed in claim 2, further comprising a position regulating portion for regulating a displacement between the first and second interfering portions when the locking securing unit is in the allowance position and the operation portion is operated.

4. The connector as claimed in claim 3, wherein the position regulating portion has a first projection on the first interfering portion and a second projection on the second interfering portion.

5. The connector as claimed in claim 4, wherein the first interfering portion projects from the locking arm and the second interfering portion projects from the locking securing unit, the first projection is disposed on a front end of the first interfering portion and the second projection is disposed on a rear end of the second interfering portion, and the second projection is positioned between the locking arm and the first projection and the first projection is positioned between an inner wall of the locking securing unit and the second projection when the locking securing unit is in the allowance position.

6. The connector as claimed in claim 1, wherein the locking arm comprises:

a pair of supporting arms having a cantilever shape, each supporting arm having a rear end connected with the connector housing and a free front end, a locking beak interconnecting the front ends of the supporting arm, and an unlocking arm connected with the front end of the supporting arm and extending toward a rear end of the supporting arm.

* * * * *